US006094777A

United States Patent [19]

Windmeisser

[11] Patent Number: 6,094,777

[45] Date of Patent: Aug. 1, 2000

[54] SUCTION HEAD FOR FLOOR CLEANING MACHINE

[75] Inventor: Dieter Windmeisser, Munchwilen, Switzerland

[73] Assignee: Diversey Lever, Plymouth, Mich.

[21] Appl. No.: 09/084,725

[22] Filed: May 26, 1998

[30] Foreign Application Priority Data

May 27, 1997 [EP] European Pat. Off. ..... 97201604

[51] Int. Cl.[7] ..... A47L 9/00

[52] U.S. Cl. ..... 15/401; 15/245

[58] Field of Search ..... 15/245, 250.451, 15/250.452, 250.1, 250.48, 250.361, 250.43, 402

[56] References Cited

U.S. PATENT DOCUMENTS

| | | | |
|---|---|---|---|
| 1,828,139 | 10/1931 | Hawrylasz . | |
| 2,088,777 | 8/1937 | Dennis . | |
| 2,531,370 | 11/1950 | Thompson . | |
| 3,118,165 | 1/1964 | Meyerhoefer | 15/402 |
| 3,371,371 | 3/1968 | Steccone . | |
| 3,434,178 | 3/1969 | Dolan et al. . | |
| 4,596,061 | 6/1986 | Henning | 15/322 |
| 5,517,717 | 5/1996 | Haberli | 15/401 |

FOREIGN PATENT DOCUMENTS

| | | | |
|---|---|---|---|
| 576 174 | 12/1993 | European Pat. Off. . | |
| 1153866 | 9/1963 | Germany | 15/245 |
| 248921 | 12/1969 | Russian Federation | 15/401 |
| 94/20010 | 9/1994 | WIPO . | |

OTHER PUBLICATIONS

European Search Report dated Sep. 10, 1998.

*Primary Examiner*—William H. Beisner

[57] ABSTRACT

A suction head for a floor cleaning machine is provided, comprising a housing (7) and at least one package (1) consisting of a squeegee blade (2) and a clip element (3), whereby the size and shape of said clip element (3) and the housing (7) are such that this package can be removably fixed into the housing, and whereby the squeegee blade contains one or more holes (4) of which the size and shape are such that they fit to clipping parts (5) present at the inner surface of clip element (3) so as to removably fix the squeegee blade into the clip element.

8 Claims, 2 Drawing Sheets

SUCTION HEAD FOR FLOOR CLEANING MACHINE

FIELD OF THE INVENTION

The present invention relates to an apparatus for cleaning floor surfaces. The invention is particularly concerned with a suction head arrangement suitable for use with a wet floor cleaning machine.

BACKGROUND OF THE INVENTION

It has been known in the past to employ a mobile suction head as part of a machine for the cleaning of floor surfaces, especially a machine for wet cleaning of such surfaces.

U.S. Pat. No. 2,531,370 discloses a suction mop suitable for use in scrubbing floors and the like. This suction mop comprises a mop head including a U-shaped channel in which an inverted squeegee blade can be removably supported.

U.S. Pat. No. 3,434,178 relates to a vacuum cleaner comprising a vacuum suction nozzle having an inlet near the floor, and an elongate floor brush located near this inlet. This brush is resiliently attached to the vacuum nozzle by way of a U-shaped clip coupled to the nozzle by way of a leaf spring.

U.S. Pat. No. 3,371,371 discloses vacuuming equipment for treating floors, in particular a pick-up tool assembly comprising a vacuum head, means for positioning said vacuum head in a fixed functional relationship to the surface to be cleaned, while in use. These positioning means include a non-removable elongate squeegee which is attached to the assembly by a pair of clip elements.

Furthermore, WO-94/20010 discloses a suction head for a floor cleaning machine comprising a housing and a package consisting of a squeegee blade and a clip element, whereby the size and shape of said clip element and the housing are such that this package can be removably fixed into the housing and the squeegee blade can be removably fixed into the clip element. For obtaining an effective removable fixation of the squeegee blade inside the clip element, the clip element according to this document comprises sharp projections on the inner surface thereof.

However, even when using a clip element with such sharp projections in a suction head configuration according to WO-94/20010, a significant amount of skill was found to be required to ensure that the squeegee blade is well fixed over its entire length. Furthermore, the suction head configuration disclosed by WO-94/20010 is sensitive for tolerances in squeegee blade thickness, which also endangers the reliability of the squeegee blade fixation in the clip element.

It is an object of the present invention to provide a suction head for a floor cleaning machine, comprising a squeegee blade which is removably fixed and having a configuration such that the above-mentioned problems are overcome.

It is also an object of the present invention to provide a suction head configuration which can be simply and reliably operated and allows efficient use of the squeegee blade applied therein.

It has now surprisingly been found that these and other objects can be achieved by the suction head according to the present invention.

DEFINITION OF THE PRESENT INVENTION

Acoording to a first aspect of the present invention, there is provided a suction head for a floor cleaning machine, comprising a housing and at least one package consisting of a squeegee blade and a clip element, whereby the size and shape of said clip element and the housing are such that this package can be removably fixed into the housing, and whereby the squeegee blade contains one or more holes of which the size and shape are such that they fit to clipping parts present at the inner surface of clip element so as to removably fix the squeegee blade into the clip element. The invention also provides a package consisting of a squeegee blade and a clip element, said package being suitable fot use in a suction head according to the invention, whereby the size and shape of the clip element are such that the package can be removably fixed into the housing of the suction head, and whereby the squeegee blade contains one or more holes of which the size and location are such that they fit to clipping parts present at the inner surface of the clip element so as to removably fix the squeegee blade into the clip element.

DETAILED DESCRIPTION OF THE INVENTION

The first aspect of the invention is concerned with a suction head for a floor cleaning machine, preferably a wet floor cleaning or floor polishing machine. This suction head comprises at least one removable package consisting of a removable squeegee blade and a clip element.

It was found to be remarkably simple to prepare this suction head for use as part of a floor cleaning machine: the squeegee blade could be easily and reliably fixed into the clip element and the thus formed package could in turn be simply fixed into the housing. As a result, a good fixation of the squeegee blade in the housing was guaranteed, resulting in a good suction result. Furthermore, the suction head configuration of the invention was found to be unexpectedly versatile in that it could be used with squeegee blades of varying thickness. In addition, when using this suction head arrangement, it was found that replacement of squeegee blades could be carried out quickly and easily.

It is preferred to apply more than one package in the suction head of the present invention. Reason is that such use of more than one package overcomes any transport and storage problems, which may occur due to the oblong shape and length of usual suction head arrangements. Another advantage of applying more than one package segment is that this allows replacement of only that segment which has been worn out.

For reasons of easy exchange of these package segments, they have preferably the same size.

In order to ensure a tight fixation of the package in the suction head, a U-shaped clip element is preferably applied which can be tightly fixed in a similarly shaped—i.e. inverted U-shaped—channel in the housing of the suction head.

For obtaining an effective removable fixation of the squeegee blade into the clip element, it is desirable that more than one clipping parts are present on the inner surface of the clip element. For the same reason, said clipping parts are preferably arranged at regular intervals along the length of the clip element.

The second aspect of the invention is concerned with a package consisting of a squeegee blade and a clip element, which is suitable for use in a suction head according to the invention.

In view of the construction of this package, which warrants easy removability of the squeegee blade, we found that the operating lifetime of the squeegee blade could be considerably increased when applying an oblong squeegee blade of which at least two edges can be used for cleaning purposes. Most preferably, the construction of the suction head of the present invention is such that all four edges of the squeegee blade can be used for cleaning purposes. When one of the edges has been worn out, this squeegee blade does not need to be replaced; it can, instead, be turned along its longitudinal and/or vertical axis after having removed it from the package, such that another edge is applied for cleaning purposes.

The squeegee blade suitable for use in the suction head of the present invention, is preferably somewhat flexible; it is, therefore, desirably made of a plastic material such as poly urethane or rubber. As indicated above, good cleaning results were obtained with a squeegee blade having an oblong shape; its length and breadth are preferably in the range of respectively 0.5–1.2 m and 0.03–0.1 m. The thickness of the squeegee is effectively in the range of from 3–6 mm.

The invention is illustrated by FIGS. 1–3, of which:

Figure 1A:
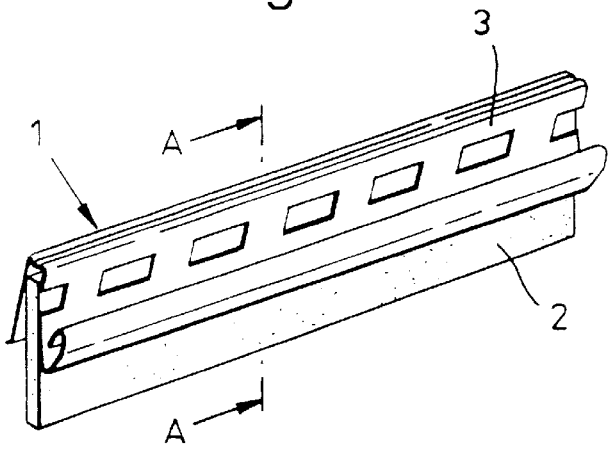
FIG. 1 shows schematic drawings of (a) a side view of a squeegee blade, a clip element and a package according to the invention and (b) cross sections of said elements along the line A—A.
Figure 1B:
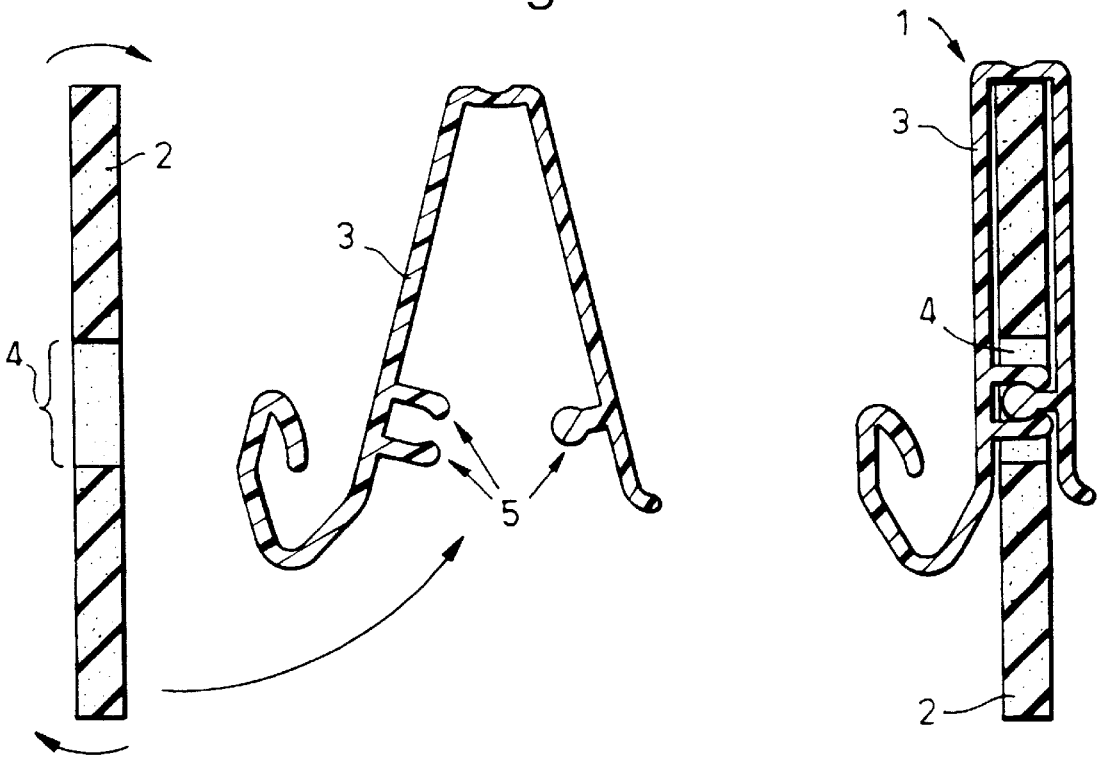

Referring now in detail to these drawings, in FIG. 1 (1) indicates a package of the invention consisting of a squeegee blade (2) and a clip element (3). It is also shown in this Figure how the squeegee blade can be removably fixed into the clip element by way of clipping parts (5) located on the inner surface of the clip element (3), which parts fit into holes (4) present on the squeegee blade (2). The side view of the package (1) shows an embodiment in which the clip element (3) contains rectangular holes in between the clipping parts (5). Since these clipping parts (5) are present on the inner surface of clip element (3), they are not shown on said side view.

Figure 2:
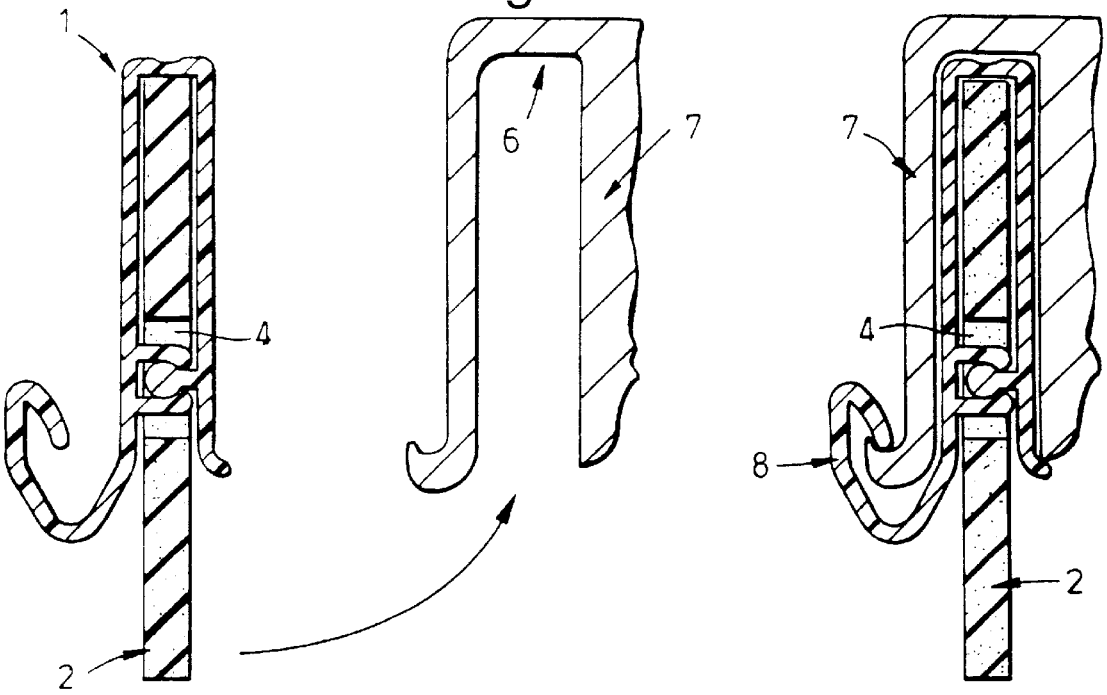
FIG. 2 shows schematic drawings of cross-sections of said package, the part of a suction head of the invention substantially consisting of a U-shaped channel, and said channel into which said package has been positioned.

In FIG. 2, it is shown how the package of the invention (1) can be tightly fixed into the housing (7) of a suction head by way of a U-shaped channel (6). Adequate fixation is accomplished by applying a clip element having a part (8) which can be attached to the housing as indicated.

Figure 3:
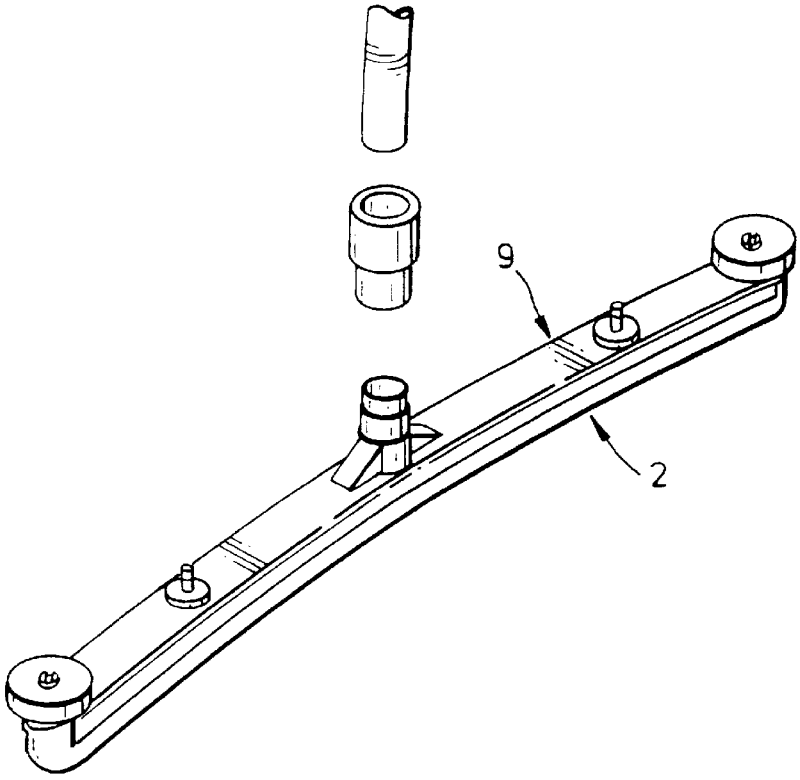
FIG. 3 shows a schematic view of a complete suction head of the invention.

In FIG. 3, a suction head (9) according to the present invention is shown which can be coupled to any suction system suitable for use in a wet floor cleaning machine.

It is emphasized that the suction head and package shown in the Figures illustrate only one preferred embodiment of the invention and that various constructional alternatives will be immediately evident to the man skilled in the art, without departing from the scope of the prsent invention.

I claim:

1. A suction head for a floor cleaning machine, comprising a housing (7) and at least one package (1) consisting of a squeegee blade (2) and clip element (3), whereby said clip element (3) and the housing (7) are of a size and shape such that said package can be removably fixed into the housing, and whereby the squeegee blade contains one or more holes (4) of which the holes have a size and shape such that the holes fit to clipping parts (5) present at an inner surface of clip element (3) so as to removably fix the squeegee blade into the clip element.

2. Suction head according to claim 1, wherein the clip element (3) has a U-shape and wherein the housing (7) comprises an inverted U-shaped channel (6) into which the clip element can be fixed.

3. Suction head according to claim 1, wherein the housing and package have an oblong shape.

4. Suction head according to claim 1, wherein the clipping parts (5) are arranged at regular intervals along the clip element (3).

5. Suction head according to claim 1, wherein the suction head contains at least 2 packages (1).

6. A suction head according to claim 1 wherein the clipping parts (5) comprise of a first and second portion wherein the first and second portion extend through at least one hole in the squeegee and the first portion fits into the second portion.

7. Package consisting of a squeegee blade (2) and a clip element (3), said package being suitable for use in a suction head, whereby the clip element has a size and shape such that the package can be removably fixed into a housing (7) of the suction head, and whereby the squeegee blade contains one or more holes (4) having a size and location such that the holes fit to clipping parts (5) present at an inner surface of the clip element (3) so as to removably fix the squeegee blade (2) into the clip element.

8. Package according to claim 7, wherein the package has an oblong shape and a squeegee blade with four edges, whereby all four edges of the squeegee blade present in the package can be applied for cleaning purposes.

* * * * *